US007487730B2

(12) United States Patent
Hedstrom

(10) Patent No.: US 7,487,730 B2
(45) **Date of Patent: *Feb. 10, 2009**

(54) PALLET WITH STEPPED SUPPORT BLOCKS AND RELATED METHODS

(75) Inventor: Kristen Karl Hedstrom, Orlando, FL (US)

(73) Assignee: Chep Technology Pty Limited, Sydney (AU)

( * ) Notice: Subject to any disclaimer, the term of this patent is extended or adjusted under 35 U.S.C. 154(b) by 0 days.

This patent is subject to a terminal disclaimer.

(21) Appl. No.: 11/678,806

(22) Filed: Feb. 26, 2007

(65) Prior Publication Data

US 2007/0209557 A1 Sep. 13, 2007

Related U.S. Application Data

(60) Provisional application No. 60/828,522, filed on Oct. 6, 2006, provisional application No. 60/777,434, filed on Feb. 28, 2006.

(51) Int. Cl.
*B65D 19/16* (2006.01)

(52) U.S. Cl. ..... 108/56.3; 108/57.17

(58) Field of Classification Search ..... 206/386, 206/595, 596, 598, 599, 600; 108/56.1, 56.3, 108/51.11, 57.17, 57.21, 57.25, 57.33
See application file for complete search history.

(56) References Cited

U.S. PATENT DOCUMENTS

| | | | | | |
|---|---|---|---|---|---|
| 2,503,022 | A | * | 4/1950 | Benoist et al. | 108/57.17 |
| 2,542,129 | A | * | 2/1951 | Fletcher | 108/57.1 |
| 2,919,090 | A | | 12/1959 | De Pew | 248/120 |
| 2,967,036 | A | | 1/1961 | Phillips | 248/120 |
| 3,126,843 | A | | 3/1964 | De Laney | 108/52 |
| 3,212,462 | A | * | 10/1965 | Pasquier | 108/51.11 |
| 3,910,203 | A | | 10/1975 | Hamkins et al. | 108/51 |
| 4,159,681 | A | | 7/1979 | Vandament | 108/51.1 |
| 4,220,099 | A | | 9/1980 | Marchesano | 108/51.1 |
| 4,240,358 | A | | 12/1980 | Munroe | 108/51.1 |
| 4,715,294 | A | | 12/1987 | Depew | 108/51.1 |
| D306,226 | S | | 2/1990 | Jirucha | D34/38 |
| 5,076,175 | A | | 12/1991 | Whatlet, II | 108/51.1 |
| 5,351,628 | A | * | 10/1994 | Breezer et al. | 108/56.1 |
| 5,673,629 | A | | 10/1997 | Ginnow | 108/51.1 |
| D390,317 | S | | 2/1998 | Fenton | D34/38 |
| 5,809,902 | A | | 9/1998 | Zetterberg | 108/51.1 |
| 5,887,529 | A | * | 3/1999 | John et al. | 108/56.1 |
| 5,960,721 | A | | 10/1999 | Huetteman et al. | 108/57.17 |

(Continued)

FOREIGN PATENT DOCUMENTS

| | | |
|---|---|---|
| FR | 2660283 | 10/1991 |

(Continued)

*Primary Examiner*—Janet M Wilkens
(74) *Attorney, Agent, or Firm*—Allen, Dyer, Doppelt, Milbrath & Gilchrist, P.A.

(57) ABSTRACT

A pallet includes a base layer and a cargo layer. The cargo layer includes a pair of spaced apart end deck boards, and a pair of spaced apart connector boards orthogonal to the pair of spaced apart end deck boards. Spaced apart support blocks are coupled between the base and cargo layers and form a gap therebetween for receiving a lifting member. Each support block includes a stepped top surface having a first level for receiving an end deck board and second level for receiving a connector board.

40 Claims, 5 Drawing Sheets

U.S. PATENT DOCUMENTS

| | | | | |
|---|---|---|---|---|
| 6,003,448 | A | 12/1999 | Skuse | 108/51.11 |
| 6,584,915 | B1 | 7/2003 | Rogers | 108/56.1 |
| 2006/0005746 | A1 | 1/2006 | Gouldin, Jr. | 108/51.11 |

FOREIGN PATENT DOCUMENTS

| | | |
|---|---|---|
| GB | 2288783 | 11/1995 |
| JP | 9165039 | 6/1997 |
| WO | 2004/106179 | 12/2004 |

* cited by examiner

PALLET WITH STEPPED SUPPORT BLOCKS AND RELATED METHODS

RELATED APPLICATIONS

This application claims the benefit of U.S. Provisional Application Ser. Nos. 60/777,434 filed Feb. 28, 2006 and 60/828,522 filed Oct. 6, 2006, the entire contents of which are incorporated herein by reference.

FIELD OF THE INVENTION

The present invention relates to the field of pallets, and more particularly, to a pallet having an improved resilience to impacts from material handling equipment, and to related methods for making the same.

BACKGROUND OF THE INVENTION

Conventional pallets include a base layer and a cargo layer separated therefrom by support blocks. Traditionally, the base and cargo layers respectively have end deck boards of a common thickness assembled on connector boards that run the full length or width of the pallet. The end deck boards are nailed through the connector boards into the support blocks to build the primary structure of the pallet. Intermediate deck boards are placed between the end deck boards. The end deck boards are also known as lead boards.

To move the pallet with cargo thereon, forklift tines are inserted into the gaps between the base and cargo layers. If the forklift is not stopped in time, the forklift may crash into one of the end deck boards of the pallet. The end deck board may not be able to withstand such an impact over time. Accidents such as this weaken the pallet and greatly shorten the lifespan of the pallet, thereby causing the pallet to be repaired more frequently and/or removed from service long before its anticipated life cycle has been reached.

In an effort to improve pallet durability, an intermediate deck board may butt up against an end deck board to help resist impacts from material handling equipment. While this technique is effective at generating more resistance, the effect of a failure is often two boards being broken instead of just one.

Another approach is disclosed in U.S. Pat. No. 4,220,099 to Marchesano. The '099 patent discloses a pallet comprising at least two runners, and a plurality of deck boards or stringers coupled to the runners. In particular, the end deck boards in the cargo layer are dadoed or undercut into the runners to thereby strengthen the pallet. The end deck boards in the base layer are received in recessed portions of the runners so that they butt up against the runners. This may be effective in strengthening the pallet, but undercutting the end deck boards for the cargo layer and the corresponding runners is a time consuming process, and as a result, adds to the expense of building a pallet.

SUMMARY OF THE INVENTION

In view of the foregoing background, it is therefore an object of the present invention to provide a pallet having an improved resilience to impacts from material handling equipment without increasing the cost as compared to conventional block pallets.

This and other objects, features, and advantages in accordance with the present invention are provided by a pallet comprising a base layer, and a cargo layer comprising a pair of spaced apart end deck boards, and a pair of spaced apart connector boards orthogonal to the pair of spaced apart end deck boards. A plurality of spaced apart support blocks may be coupled between the base and cargo layers and forming a gap therebetween for receiving a lifting member. Each support block may comprise a stepped top surface including a first level for receiving an end deck board, and a second level for receiving a connector board.

An advantage of the stepped top surface of the support blocks is that when an impact force is applied to an end deck board, the force is advantageously transmitted to the ends of the connector boards. As a result, the energy of the impact is dissipated over the length of the pallet. More specifically, the end grain of the connector boards absorb the impact force instead of the nail joints used to secure an end deck board to the support blocks. The stepped top surface thus improves the resiliency to impacts from material handling equipment as compared to a conventional block pallet.

The cargo layer may further comprise intermediate deck boards coupled to the pair of connector boards. The intermediate deck boards may be substantially parallel to the pair of end deck boards. An outer exposed top surface of the intermediate deck boards may be coplanar with outer exposed top surfaces of the pair of end deck boards.

Another advantage of the stepped top surface of the support blocks is that the thickness of the end deck boards is independent of the thickness of the intermediate deck boards. This advantageously allows for thinner intermediate deck boards. The overall result is a lower cost pallet that is more durable than a conventional block pallet.

The base layer may comprise a pair of spaced apart end deck boards, and a pair of spaced apart connector boards orthogonal to the pair of spaced apart end deck boards. Each support block may further comprise a stepped bottom surface including a first level for receiving an end deck board from the base layer and a second level for receiving a connector board from said base layer.

As with the stepped top surface, an advantage of the stepped bottom surface of the support blocks is that when an impact force is applied to the end deck boards of the pallet, the force is advantageously transmitted to the ends of the connector boards so that the energy of the impact is dissipated over the length of the pallet. Yet another advantage of the bottom stepped surface is that a thickness of the end deck boards may be greater than a thickness of the connector boards. The stepped bottom surface thus improves the resiliency to impacts from material handling equipment as compared to a conventional block pallet.

Another aspect of the invention is directed to a method for making a pallet comprising a base layer, and a cargo layer comprising a pair of spaced apart end deck boards, and a pair of spaced apart connector boards orthogonal to the pair of spaced apart end deck boards. The method comprises coupling a plurality of spaced apart support blocks between the base and cargo layers and forming a gap therebetween for receiving a lifting member. Each support block may comprise a stepped top surface including a first level for receiving an end deck board, and second level for receiving a connector board from the cargo layer.

DETAILED DESCRIPTION OF THE PREFERRED EMBODIMENTS

Figure 1:
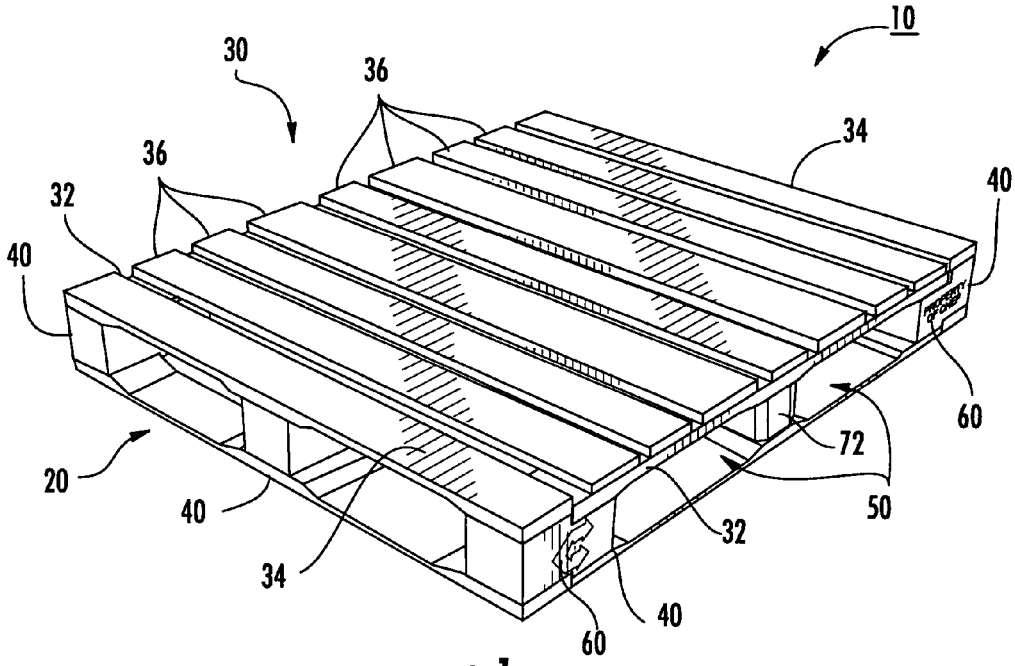
FIG. 1 is a top perspective view of a pallet in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notations are used to indicate similar elements in alternative embodiments.

Referring initially to FIGS. 1-4, the pallet 10 in accordance with the invention comprises a base layer 20, a cargo layer 30 and a plurality of "stepped" support blocks 40. The support blocks 40 are coupled between the base and cargo layers 20, 30 and define a space 50 therebetween for receiving at least one lifting member of material handling equipment, such as a fork lift tine.

The pallet 10 is preferably made out of wood. However, other types of materials or composites may be used to form the pallet, as readily appreciated by those skilled in the art. These other materials and composites may or may not include wood. For purposes of discussion, the illustrated pallet 10 is made out of wood.

As will be discussed in greater detail below, the upper surface of the support blocks has multiple levels so that boards from the cargo layer 30 are coupled at different levels to the support blocks. This configuration of the support blocks is known as single stepped support blocks. Likewise, the lower surface of the support blocks may have multiple levels so that boards from the base layer 20 are coupled at different levels to the support blocks. This configuration of the support blocks is known double stepped support blocks. The single and double stepped support blocks advantageously improve the resiliency of the pallet 10 to withstand impacts from material handling equipment.

The cargo layer 30 comprises a pair of spaced apart connector boards 32, and a pair of spaced apart end deck boards 34 orthogonal to the connector boards so that the cargo layer has a rectangular shape. Each support block 40 comprises a stepped top surface including a first level 48*a* for receiving an end deck board 34, and a second level 48*b* for receiving a connector board 32. In addition to the pair of connector boards 32, additional support blocks 40 are positioned along the end deck boards 34 so that at least one more connector board 32 extends parallel to the pair of connector boards.

The stepped top surface of each support block 40 is configured so that the first level 48*a* is above the second level 48*b* with a transition wall 49 defined therebetween. As a result, an end of each connector board 32 is adjacent the transition wall 49 in the support block 40 coupled thereto. For manufacturing and assembly purposes, there is normally a tolerance gap between the transition wall 49 and the end of the corresponding connector board 32. However, the end deck boards 34 are normally positioned so that they butt up against ends of the connector boards 32.

When an impact force is applied to an end deck board 34, the force is transmitted to the ends of the connector boards 32 so that the energy of the impact is dissipated over the length of the pallet. More specifically, the end grain of the connector boards 32 absorb the impact force instead of the nail joints used to secure the end deck boards 34 to the support blocks 40. The stepped top surface thus improves the resiliency to impacts from material handling equipment as compared to a conventional block pallet.

The cargo layer 30 further comprises spaced apart intermediate deck boards 36 coupled to the connector boards 32. The intermediate deck boards 36 are substantially parallel to the end deck boards 34. An outer exposed top surface of the intermediate deck boards 36 is coplanar with outer exposed top surfaces of the end deck boards 34.

Another advantage of the stepped top surface of the support blocks 40 is that the thickness of the end deck boards 34 is independent of the thickness of the intermediate deck boards 36. This advantageously allows for thinner intermediate deck boards 36. The overall result is a lower cost pallet 10 that is more durable than a conventional block pallet.

Figure 5:
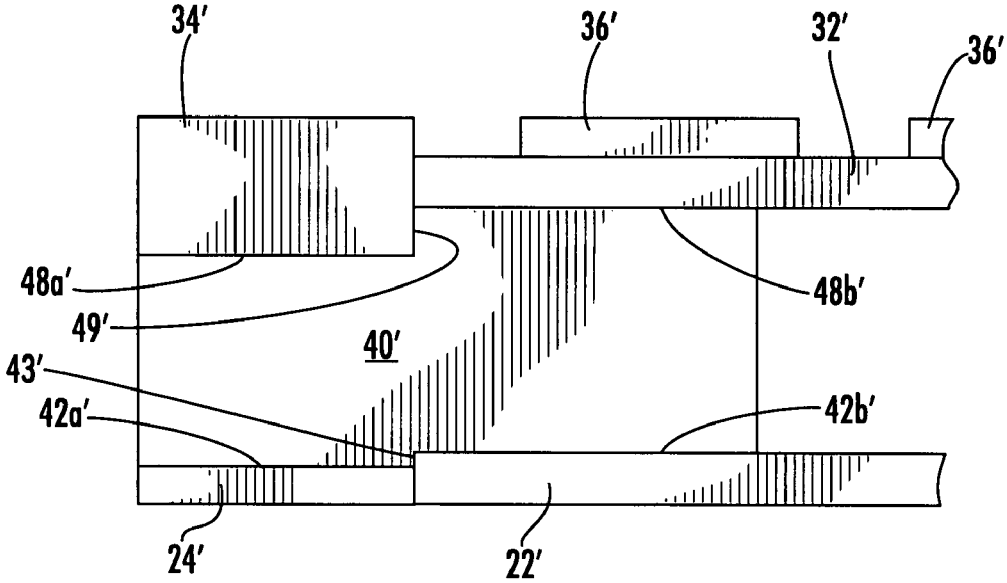
FIG. 5 is a side view of another embodiment of the support block in accordance with the present invention.

In an alternate embodiment, the stepped top surface of each support block 40' may be configured so that the first level 48*a*' is below the second level 48*b*' with a transition wall 49' defined therebetween, as shown in FIG. 5. This time, however, one side of each end deck board 34' is adjacent the transition wall 49' in the support blocks 40' coupled thereto.

Still referring to FIGS. 1-4, the base layer 20 comprises a pair of spaced apart end deck boards 24, and a pair of spaced apart connector boards 22 orthogonal to the end deck boards so that the base layer has a rectangular shape. Each support block 40 further comprises a stepped bottom surface including a first level 42*a* for receiving an end deck board 24 from the base layer, and a second level 42*b* for receiving a connector board 22 from the base layer.

The stepped top and bottom surfaces for each support block 40 thus defines a double stepped support block. The double stepped support block 40 advantageously improves the resiliency of the pallet 10 to withstand impacts from material handling equipment.

Figure 4:
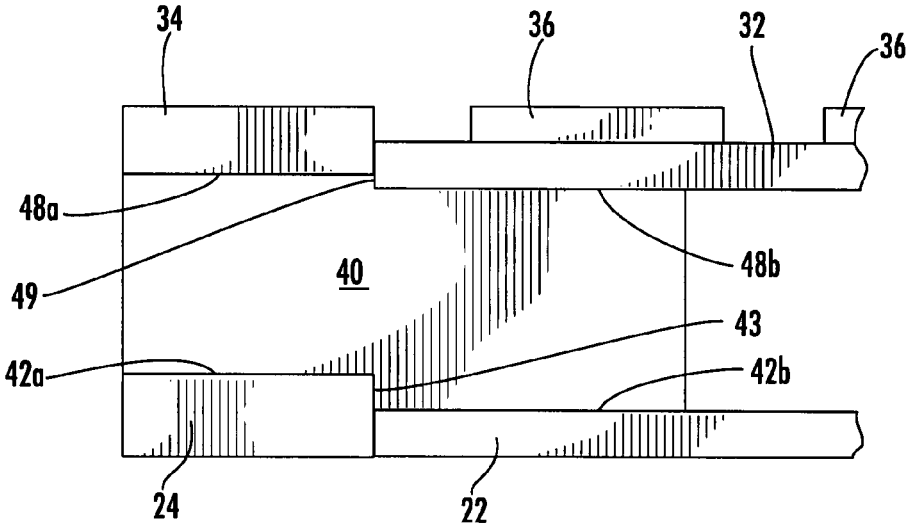
FIG. 4 is a side view of a support block shown in FIG. 1 with the end deck boards, the connector boards and the intermediate deck boards coupled thereto.

An outer exposed bottom surface of each connector board 22 and an outer exposed bottom surface of each end deck board 24 from the base layer 20 are coplanar. As best shown in FIG. 4, the stepped bottom surface of each support block 40 is configured so that the first level 42*a* is above the second level 42*b* with a transition wall 43 defined therebetween. As a result, one side of each end deck board 24 from the base layer 20 is adjacent the transition wall 43 in the support blocks 40 coupled thereto.

In an alternate embodiment, the stepped bottom surface of each support block 40' may be configured so that the first level 42*a*' is below the second level 42*b*' with a transition wall 43' defined therebetween, as shown in FIG. 5. This time, however, an end of each connector board 22' is adjacent the transition wall 43' in the support block 40' coupled thereto.

Figure 6:
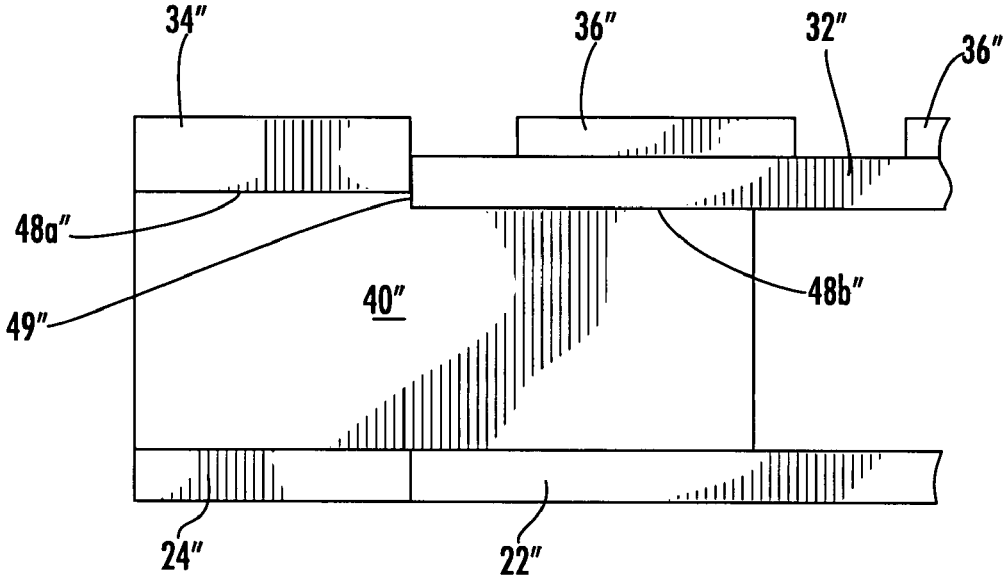
FIG. 6 is a side view of yet another embodiment of the support block in accordance with the present invention.

In yet another embodiment, the bottom surface of each support block 40" may be coplanar, as shown in FIG. 6. The end deck boards 24" and the connector boards 22" in the base layer 20" have the same thickness. In addition, the connector board 22" may butt up against the end deck board 24" in the base layer 20". In this embodiment, the end deck boards 24" and the connector boards 22" in the base layer 20" have the same thickness. This embodiment defines a single stepped support block 40". Even with a single stepped support block 40, the resiliency of the pallet 10 to withstand impacts from material handling equipment is advantageously improved as compared to a conventional block pallet.

The different levels of the first and second levels in the top surface of the support blocks, and the different levels of the first and second levels in the bottom surface of the supports blocks may be mixed and matched for a configuration not shown in the drawings. For example, the first level 48*a*' is below the second level 48*b*' in the top stepped surface of the support block as shown in FIG. 5, but the first level 42*a* may be above the second level 42*b* as shown in FIG. 4.

Figure 7:
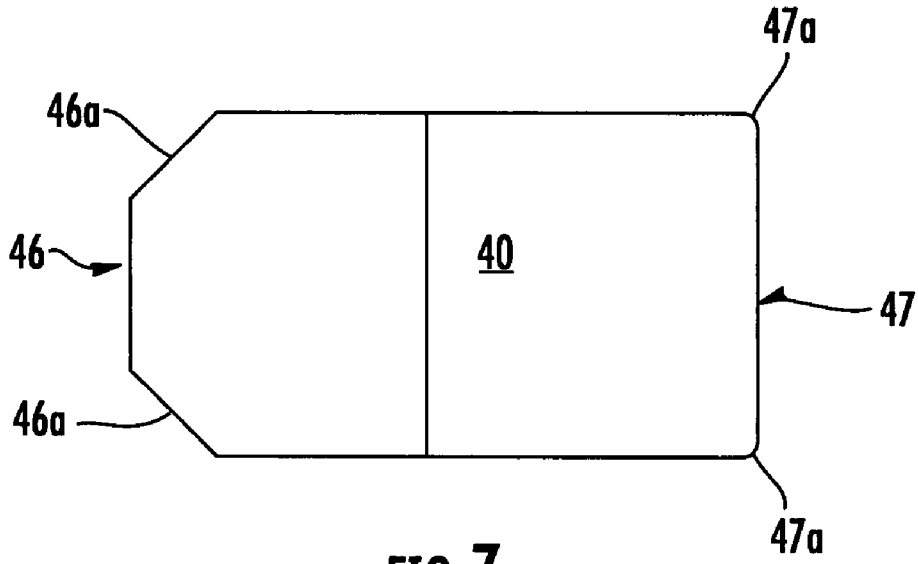
FIG. 7 is a top view of the support block in accordance with the present invention.

The edges of each support block 40 extending between the base layer 20 and the cargo layer 30 may be curved and/or angled, as best shown by the top view of the support block in FIG. 7. The inner face 46 of the support block 40 is inserted into the opening 50 of the pallet 10, and includes angled edges 46*a*. The angled edges 46*a* may be within a range of about 25 to 75 degrees, for example, to deflect the impact force of the forklift tines should such an impact occur. The illustrated edges are angled at 45 degrees.

Figure 2:
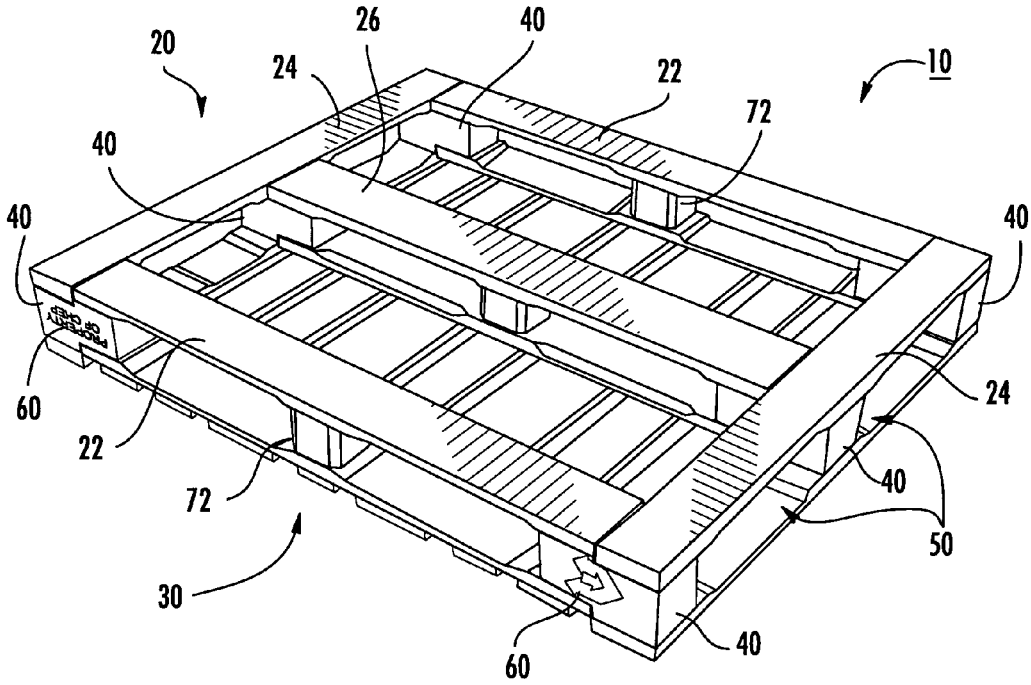
FIG. 2 is a bottom perspective view of the pallet shown in FIG. 1.
Figure 3:
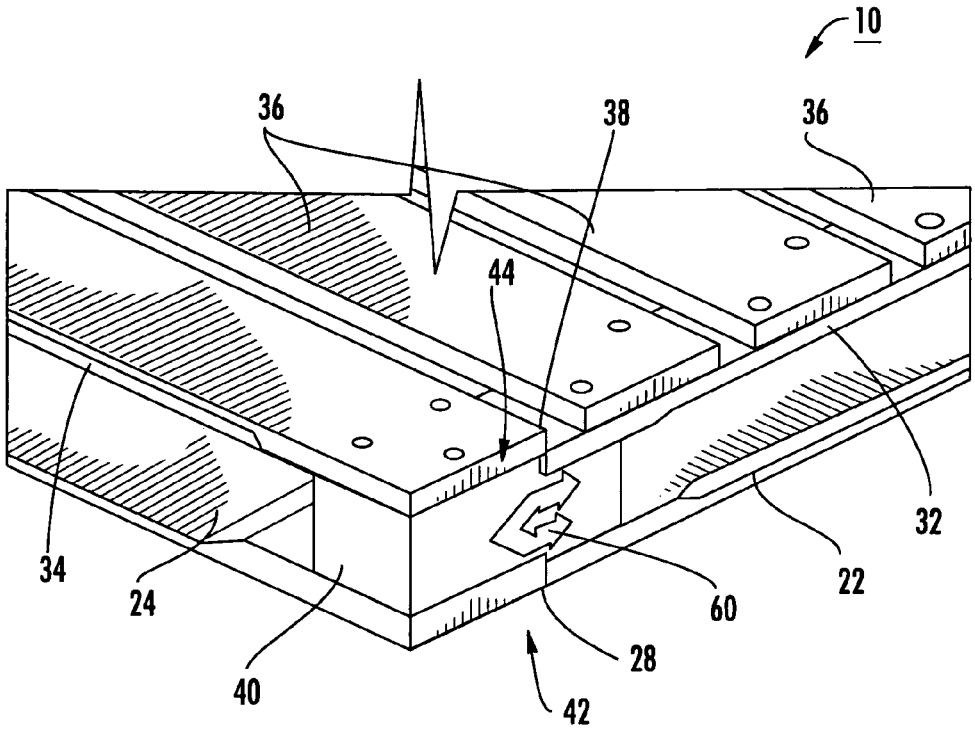
FIG. 3 is an enlarged perspective view of a corner of the pallet shown in FIG. 1.

The outer face 47 of the support block 40 facing away from the opening 50 of the pallet 10, and includes angled edges 47*a*. The angled edges have a curved radius within a range of about 2 to 12 mm, for example, and preferably within a range of about 4 to 8 mm. Indicia 60 may also be placed on the outer facing sidewalls of the support blocks 40, as shown in FIGS. 1-3. Alternatively, the edges of the support blocks 40 may all be angled or they may all be curved. Of course, the adjacent surfaces of the support block 40 defining an edge could be orthogonal to one another so that the edges or neither curved or angled. Instead, the edges of pointed.

The pallet 10 further comprises a plurality of intermediate support blocks 72 coupled between the base layer 20 and the cargo layer 32. Each intermediate support block 72 has coplanar top and bottom surfaces for receiving the respective connector boards 22, 32 from the base and cargo layers 20, 30.

Figure 8:
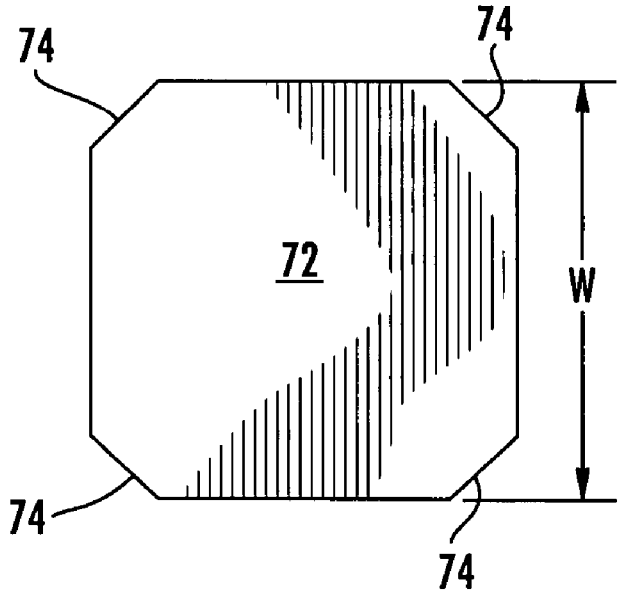
FIG. 8 is a top view of an intermediate support block in accordance with the present invention.

The intermediate support blocks 72 are rectangular shaped, as best shown by the top view in FIG. 8. The width w of each intermediate support block 72 is preferably the same width as the connector boards 22, 32 in the base and cargo layers 20, 30. The edges 74 of the intermediate support block 72 may be similar to the edges of the support blocks 40. As shown in FIG. 8, the edges are angled at 45 degrees, for example.

Another aspect of the invention is directed to making a pallet 10 comprising a base layer 20, and a cargo layer 30 comprising a pair of spaced apart end deck boards 34, and a pair of spaced apart connector boards 32 orthogonal to the pair of spaced apart end deck boards. The method comprises coupling a plurality of spaced apart support blocks 40 between the base and cargo layers 20, 30 and forming a gap therebetween for receiving a lifting member. Each support block 40 comprises a stepped top surface including a first level 48*a* for receiving an end deck board 34 and second level 48*b* for receiving a connector board 32 from the cargo layer 30.

Yet another aspect of the invention is directed to optimizing size and placement of the end deck boards 34 and the intermediate deck boards 36 for the cargo layer 30 of the pallet 10. Positioning and size of the deck boards 34, 36 in the cargo layer 30 provide a high percentage of coverage to support a broad range of products that may rest on the cargo layer. These products are typically packaged in cargo cases, for example.

Figure 9:
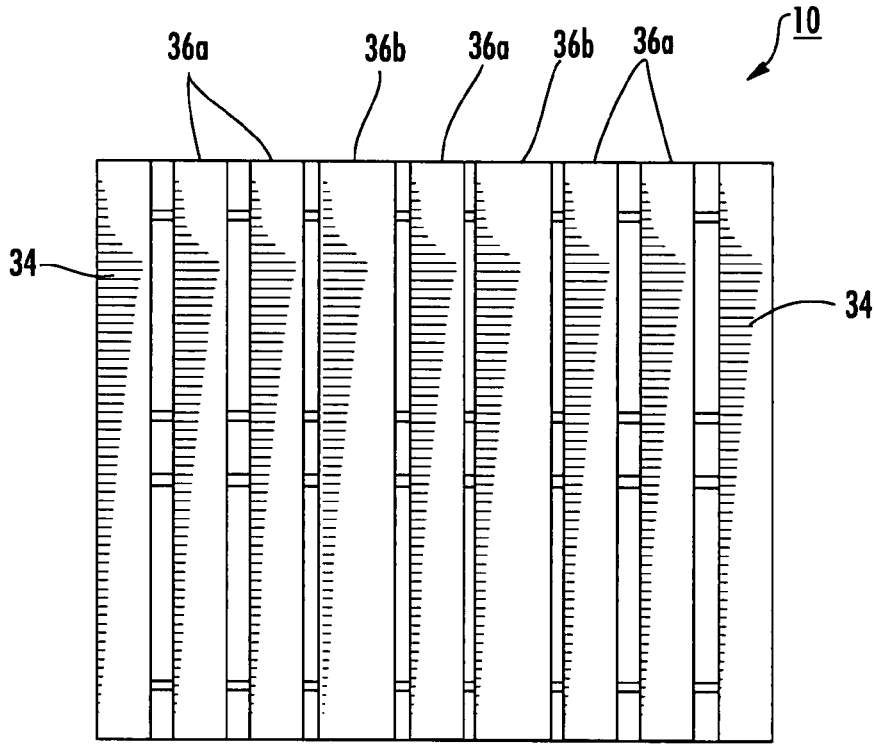
FIG. 9 is a top view of a pallet illustrating size and placement of the end deck boards and intermediate deck boards in the cargo layer in accordance with the present invention.
Figure 10:
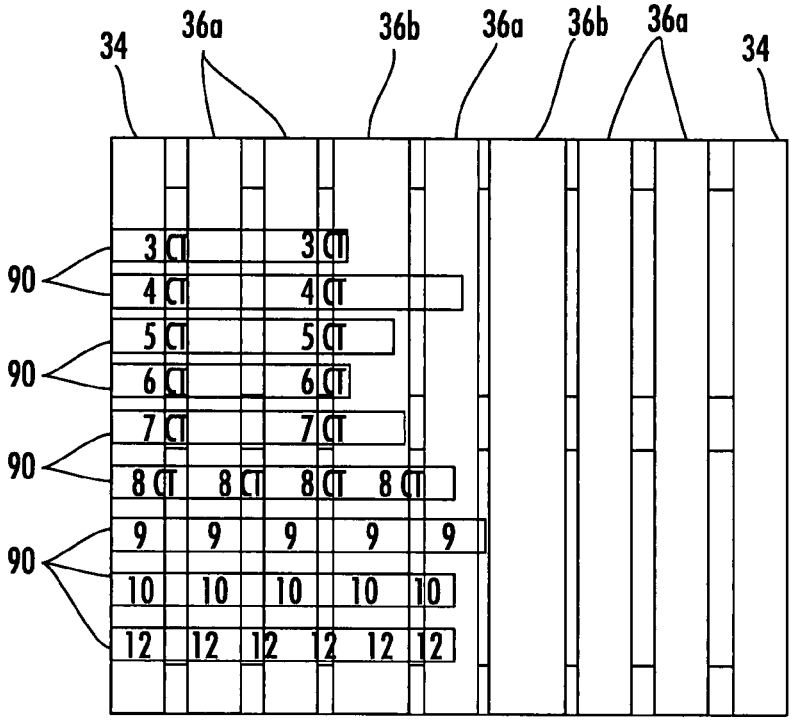
FIG. 10 is a top view of the pallet shown in FIG. 9 illustrating support of case corners for a variety of common case sizes.

In accordance with optimizing the cargo layer 30 of the pallet 10, the number and size of the intermediate deck boards 36 are to be minimized while achieving full corner support for common cargo case sizes. Referring now to FIGS. 9 and 10, two or more different size intermediate deck boards 36*a*, 36*b* and a specific pattern are used to achieve full support of cargo case corners for the most common cargo case sizes of 16", 12", 8" and 6". The cargo cases having different sizes are represented by reference 90.

Intermediate deck boards 36*a* are within a range of about 3 to 4 inches wide, whereas intermediate deck boards 36*b* are within a range of about 5 to 6 inches wide. The end deck boards 34 are also within a range of about 3 to 4 inches wide.

As illustrated in the figures, the width of the end deck boards 34 is 4 inches, the width of the intermediate deck boards 36*a* is 3.5 inches, and the width of the intermediate deck boards 36*b* is 5.5 inches. Alternatively, the end deck boards 34 may be the same width as the intermediate deck boards 36*a*, or vice-versa.

The illustrated pattern entails two 3.5 inch intermediate top deck boards 36*a*, followed by a 5.5 inch intermediate top deck board 36*b*, followed by a 3.5 inch intermediate top deck board, followed by another 5.5 inch intermediate top deck board, and then followed by two 3.5 inch intermediate top deck boards 36*a*.

The overall pattern of the intermediate top deck boards 36*a*, 36*b* with the end deck boards 34 define an outer exposed surface of the cargo layer 30 of overall dimensions 40 inches by 48 inches. The intermediate deck boards 36*a*, 36*b* are not limited to use with the illustrated support blocks 40. In other words, the optimized top deck pattern is applicable to pallets using conventional support blocks. Moreover, the optimized top deck pattern is also applicable to any type pallet design having a cargo layer.

In addition, other features relating to pallets are disclosed in the copending patent application filed concurrently herewith and assigned to the assignee of the present invention and is entitled PALLET WITH OPTIMIZED CARGO LAYER AND RELATED METHODS, attorney docket number 41052, the entire disclosure of which is incorporated herein in its entirety by reference.

Many modifications and other embodiments of the invention will come to the mind of one skilled in the art having the benefit of the teachings presented in the foregoing descriptions and the associated drawings. For instance, the step block design is applicable to a one-piece molded top deck and a one-piece molded bottom deck with deck boards that are serviceable. Therefore, it is understood that the invention is not to be limited to the specific embodiments disclosed, and that modifications and embodiments are intended to be included as readily appreciated by those skilled in the art.

That which is claimed:

1. A pallet comprising:

a base layer;

a cargo layer comprising a pair of spaced apart end deck boards, and a pair of spaced apart connector boards orthogonal to said pair of spaced apart end deck boards; and a plurality of spaced apart support blocks coupled between said base and cargo layers and forming a gap therebetween for receiving a lifting member, each support block comprising a stepped top surface including a first level receiving one of said end deck boards, and a second level receiving one of said connector boards, with the connector board being adjacent to and non-overlapping with the end deck board.

2. A pallet according to claim 1 wherein said cargo layer further comprises at least one intermediate deck board coupled to said pair of connector boards, and said at least one intermediate deck board being substantially parallel to said pair of end deck boards.

3. A pallet according to claim 2 wherein an outer exposed top surface of said at least one intermediate deck board is coplanar with outer exposed top surfaces of said pair of end deck boards.

4. A pallet according to claim 1 wherein the stepped top surface of each support block is configured so that the first level is above the second level with a transition wall defined therebetween; and wherein an end of each connector board is adjacent the transition wall in the support block coupled thereto.

5. A pallet according to claim 1 wherein the stepped top surface of each support block is configured so that the first level is below the second level with a transition wall defined therebetween; and wherein one side of each end deck board is adjacent the transition wall in the support blocks coupled thereto.

6. A pallet according to claim 1 wherein said base layer comprises a pair of spaced apart end deck boards, and a pair of spaced apart connector boards orthogonal to said pair of spaced apart end deck boards; and wherein each support block further comprises a stepped bottom surface including a first level for receiving an end deck board from said base layer and a second level for receiving a connector board from said base layer.

7. A pallet according to claim 6 wherein an outer exposed bottom surface of each connector board and an outer exposed bottom surface of each end deck board from said base layer are coplanar.

8. A pallet according to claim 6 wherein the stepped bottom surface of each support block is configured so that the first level is above the second level with a transition wall defined therebetween; and wherein one side of each end deck board from said base layer is adjacent the transition wall in the support blocks coupled thereto.

9. A pallet according to claim 6 wherein the stepped bottom surface of each support block is configured so that the first level is below the second level with a transition wall defined therebetween; and wherein an end of each connector board from said base layer is adjacent the transition wall in the support block coupled thereto.

10. A pallet according to claim 1 further comprising a plurality of intermediate support blocks coupled between said base and cargo layers, each intermediate support block comprising a coplanar top surface for receiving a connector board from said cargo layer.

11. A pallet according to claim 10 wherein edges of each support block extending between said base layer and said connector boards are curved.

12. A pallet according to claim 1 wherein edges of each support block extending between said base layer and said end deck boards are curved.

13. A pallet according to claim 1 wherein edges of each support block extending between said base layer and said connector boards are angled.

14. A pallet comprising:

a base layer;

a cargo layer comprising a pair of spaced apart end deck boards, a pair of spaced apart connector boards orthogonal to said pair of spaced apart end deck boards, and at least one intermediate deck board coupled to said pair of spaced apart connector boards; and a plurality of spaced apart support blocks coupled between said base and cargo layers and forming a gap therebetween for receiving a lifting member, each support block comprising a stepped top surface including a first level receiving one of said end deck boards, a second level receiving one of said connector boards, with the connector board being adjacent to and non-overlapping with the end deck board, and an outer exposed top surface of said at least one intermediate deck board being coplanar with outer exposed top surfaces of said pair of spaced apart end deck boards.

15. A pallet according to claim 14 wherein said at least one intermediate deck board is substantially parallel to said pair of end deck boards.

16. A pallet according to claim 14 wherein the stepped top surface of each support block is configured so that the first level is above the second level with a transition wall defined therebetween; and wherein an end of each connector board is adjacent the transition wall in the support block coupled thereto.

17. A pallet according to claim 14 wherein the stepped top surface of each support block is configured so that the first level is below the second level with a transition wall defined therebetween; and wherein one side of each end deck board is adjacent the transition wall in the support blocks coupled thereto.

18. A pallet according to claim 14 wherein said base layer comprises a pair of spaced apart end deck boards, and a pair of spaced apart connector boards orthogonal to said pair of spaced apart end deck boards; and wherein each support block further comprises a stepped bottom surface including a first level for receiving an end deck board from said base layer and a second level for receiving a connector board from said base layer.

19. A pallet according to claim 18 wherein an outer exposed bottom surface of each connector board and an outer exposed bottom surface of each end deck board from said base layer are coplanar.

20. A pallet according to claim 18 wherein the stepped bottom surface of each support block is configured so that the first level is above the second level with a transition wall defined therebetween; and wherein one side of each end deck board from said base layer is adjacent the transition wall in the support blocks coupled thereto.

21. A pallet according to claim 14 further comprising a plurality of intermediate support blocks coupled between said base and cargo layers, each intermediate support block comprising a coplanar top surface for receiving a connector board from said cargo layer.

22. A pallet according to claim 18 further comprising a plurality of intermediate support blocks coupled between said base and cargo layers, each intermediate support block comprising a coplanar top surface for receiving a connector board from said cargo layer, and a coplanar top surface for receiving a connector board from said base layer.

23. A pallet according to claim 14 wherein each support block comprises at least one of curved edges and angled edges extending between said base and cargo layers.

24. A pallet comprising:

a base layer comprising a pair of spaced apart end deck boards, and a pair of spaced apart connector boards orthogonal to said pair of spaced apart end deck boards;

a cargo layer comprising a pair of spaced apart end deck boards, and a pair of spaced apart connector boards orthogonal to said pair of spaced apart end deck boards; and a plurality of spaced apart support blocks coupled between said base and cargo layers and forming a gap therebetween for receiving a lifting member, each support block comprising a stepped top surface including a first level for receiving an end deck board and a second level for receiving a connector board from said cargo layer, and a stepped bottom surface including a first level for receiving an end deck board and a second level for receiving a connector board from said base layer.

25. A pallet according to claim 24 wherein said cargo layer further comprises at least one intermediate deck board coupled to said pair of connector boards, and said at least one intermediate deck board being substantially parallel to said pair of end deck boards from said cargo layer.

26. A pallet according to claim 25 wherein an outer exposed top surface of said at least one intermediate deck board is coplanar with outer exposed top surfaces of said pair of end deck boards from said cargo layer.

27. A pallet according to claim 24 wherein the stepped top surface of each support block is configured so that the first level is above the second level with a transition wall defined therebetween; and wherein an end of each connector board from said cargo layer is adjacent the transition wall in the support block coupled thereto.

28. A pallet according to claim 24 wherein the stepped top surface of each support block is configured so that the first level is below the second level with a transition wall defined therebetween; and wherein one side of each end deck board from said cargo layer is adjacent the transition wall in the support blocks coupled thereto.

29. A pallet according to claim 24 wherein the stepped bottom surface of each support block is configured so that the first level is above the second level with a transition wall defined therebetween; and wherein one side of each end deck board from said base layer is adjacent the transition wall in the support blocks coupled thereto.

30. A pallet according to claim 24 further comprising a plurality of intermediate support blocks coupled between said base and cargo layers, each intermediate support block comprising a coplanar top surface for receiving a connector board from said cargo layer, and a coplanar bottom surface for receiving a connector board from said base layer.

31. A pallet according to claim 24 wherein each support block comprises at least one of curved edges and angled edges extending between said base and cargo layers.

32. A method for making a pallet comprising a base layer, and a cargo layer comprising a pair of spaced apart end deck boards, and a pair of spaced apart connector boards orthogonal to the pair of spaced apart end deck boards, the method comprising:

coupling a plurality of spaced apart support blocks between the base and cargo layers and forming a gap therebetween for receiving a lifting member, each support block comprising a stepped top surface including a first level receiving one of said end deck boards and a second level receiving one of said connector boards from the cargo layer, with the connector board being adjacent to and non-overlapping with the end deck board.

33. A method according to claim 32 further comprising coupling at least one intermediate deck board to said pair of connector boards from the cargo layer, and the at least one intermediate deck board being substantially parallel to the pair of end deck boards.

34. A method according to claim 33 wherein an outer exposed top surface of the at least one intermediate deck board is coplanar with outer exposed top surfaces of the pair of end deck boards.

35. A method according to claim 32 wherein the stepped top surface of each support block is configured so that the first level is above the second level with a transition wall defined therebetween; and wherein an end of each connector board is adjacent the transition wall in the support block coupled thereto.

36. A method according to claim 32 wherein the stepped top surface of each support block is configured so that the first level is below the second level with a transition wall defined therebetween; and wherein one side of each end deck board is adjacent the transition wall in the support blocks coupled thereto.

37. A method according to claim 32 wherein the base layer comprises a pair of spaced apart end deck boards, and a pair of spaced apart connector boards orthogonal to the pair of spaced apart end deck boards; and wherein each support block further comprises a stepped bottom surface including a first level for receiving an end deck board from the base layer and a second level for receiving a connector board from the base layer.

38. A method according to claim 37 wherein the stepped bottom surface of each support block is configured so that the first level is above the second level with a transition wall defined therebetween; and wherein one side of each end deck board from the base layer is adjacent the transition wall in the support blocks coupled thereto.

39. A method according to claim 32 further comprising coupling a plurality of intermediate support blocks between the base and cargo layers, each intermediate support block comprising a coplanar top surface for receiving a connector board from the cargo layer.

40. A method according to claim 32 wherein each support block comprises at least one of curved edges and angled edges extending between the base and cargo layers.

* * * * *